United States Patent [19]

Kim

[11] Patent Number: 4,910,646

[45] Date of Patent: Mar. 20, 1990

[54] FLASHLIGHT-COIN THROWING GUN

[75] Inventor: Myung-wan Kim, Seoul, Rep. of Korea

[73] Assignee: Ki-On Trading Co., Ltd., Seoul, Rep. of Korea

[21] Appl. No.: 255,841

[22] Filed: Oct. 7, 1988

[30] Foreign Application Priority Data

Apr. 30, 1988 [KR] Rep. of Korea ..... 1988-6265[U]

[51] Int. Cl.[4] ..... F41G 1/34

[52] U.S. Cl. ..... 362/112; 362/113; 362/253; 124/42; 124/36; 124/53; 221/276; 221/232

[58] Field of Search ..... 362/111, 112, 113, 157, 362/253, 114; 446/473; 124/8, 36, 37, 42, 53; 221/199, 232, 273, 274, 276, 2, 6

[56] References Cited

U.S. PATENT DOCUMENTS

| | | | |
|---|---|---|---|
| 689,547 | 12/1901 | James | 362/113 |
| 1,415,326 | 5/1922 | Fey | 124/42 |
| 2,629,516 | 2/1953 | Badham | 362/112 |
| 3,114,362 | 12/1963 | Hellman | 362/113 |
| 3,191,588 | 6/1965 | Thew | 221/232 |
| 3,200,805 | 8/1965 | Yano | 124/36 |
| 3,487,824 | 1/1970 | Profitt | 124/42 |
| 3,515,111 | 6/1970 | Auge | 221/232 |
| 3,515,114 | 6/1970 | Carbonneau | 124/42 |
| 4,239,129 | 12/1980 | Esposito | 362/112 |
| 4,248,202 | 2/1981 | Jaworski et al. | 124/42 |

FOREIGN PATENT DOCUMENTS

| | | | |
|---|---|---|---|
| 2186274 | 8/1987 | United Kingdom | 221/6 |

*Primary Examiner*—Ira S. Lazarus
*Assistant Examiner*—Richard R. Cole
*Attorney, Agent, or Firm*—Dorsey & Whitney

[57] ABSTRACT

A flashlight-coin throwing gun has a revolver-shaped main body formed by uniting separable main bodies, each having a gunbarrel portion and a handle portion. Within the main body is a percussion mechanism for throwing a coin through the gunbarrel. A coin loading assembly delivers coins to be thrown. A trigger operably connected to the throwing mechanism initiates its operation. A light bulb operably connected to the trigger projects light in the same direction as a coil is thrown.

10 Claims, 5 Drawing Sheets

FLASHLIGHT-COIN THROWING GUN

TECHNICAL FIELD

The present invention relates to a device that throws coins and can also be used as a flashlight.

BACKGROUND ART

To give the usual instance, when a vehicle is driven into a tunnel or on a toll road, a coin must be thrown into a coin box. At this time, the driver throws a coin into the coin box by his hand with the vehicle made to stop.

In order to throw a coin into the coin box, the driver stops his vehicle and fumbles in his pocket for a coin. When a coin is thrown strongly, it hits against the coin box and jumps out in many instances. When a coin is thrown weakly from a distance, it fails to reach the coin box and falls on the ground and the automatic signal lifting gate does not operate.

Thus, the driver must be very careful about it. During the night, it is not so easy for the driver to throw a coin correctly into the coin box.

Due to the problem as described hereinabove, the automatic control function of automatic lifting gates installed at a toll gate is closed down, and a watchman is permanently stationed there.

Also, when a part of the vehicle gets out of order while it is running in the nighttime, the driver requires a flashlight. Usually the driver is not equipped with one, and he gets into trouble very often.

SUMMARY OF THE INVENTION

The present invention relates to a flashlight-coin throwing gun, in which a coin throwing assembly and a percussion aassembly connected with the trigger are formed and by which loaded coins are made to be thrown into a coin box one by one as occasion arises. The invention may be easily used as a coin throwing gun at a toll road. An alarm and an LED are installed as a function to signal that a coin is thrown and whether there is a coin left or not. The device may also be used as a flashlight by installing a lamp in front of the gunbarrel.

In consideration of such problems as described hereinbefore, the present invention is designed to afford convenience to the driver by enabling him to throw a coin correctly into the coin box installed at a toll gate and, during the night, by allowing him the use of a light therein. It is also aimed at being used as a flashlight by him in the nighttime.

(A) and (B) are a side view and a plan view, respectively, showing a coin in condition to be ejected.

(C) and (D) are a side view and a plan view, respectively, showing a coin ready for being ejected by pulling the trigger.

(E) and (F) are a side view and a plan view, respectively, showing a coin that is being ejected.

Figure 6A:
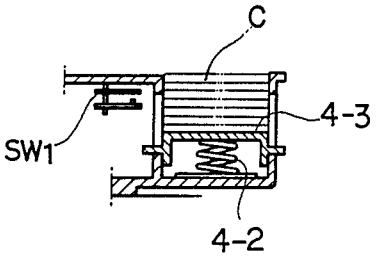
Figure 6B:
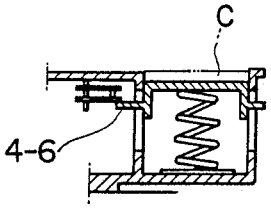

FIG. 6 (A), (B) are side views of the coin loading assembly of the present invention.

Figure 7:
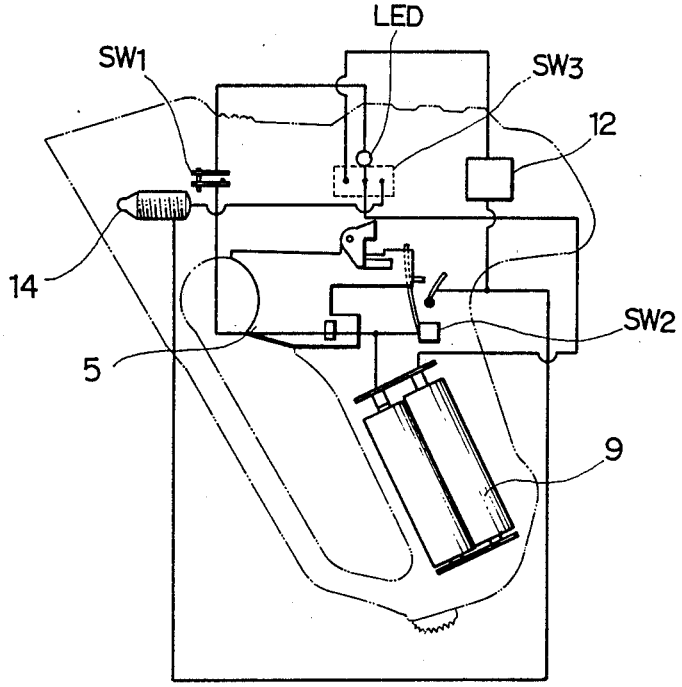

FIG. 7 is a wiring diagram of the present invention.

DESCRIPTION OF THE PREFERRED EMBODIMENT

The following explains the numbering of the parts on the drawings:

| | |
|---|---|
| 1: Main body | 1a, 1b: Separable main body parts |
| 2: Gunbarrel | 3: Handle part |
| 4: Loading chamber | 4-1: Separable loading compartment |
| 4-2: Spring | 4-3: Elastic plate |
| 4-4: Coin throwing slot | 4-5: Opening/closing plate |
| 4-6: Projection | 4-7: Groove for ascent and descent |
| 5: Trigger | 5-1: Safety hole |
| 5-2: Percussion lever | 5-3: Pin |
| 5-4: Catching jaw | 6: Percussion assembly |
| 6-1: Striking plate | 6-2: Common axis |
| 6-3: Interlocking plate | 6-4: Spring |
| 7: Flat spring | 8: Safety pin |
| 9: Dry battery | 10: Battery chamber |
| 11: Cover | 12: Alarm |
| C: Coin | 13: Reflecting mirror |
| 13-1: Installing groove | 14: Light bulb |
| SW1: Switch | SW2: Change-over switch |
| S1, S2: Connecting pieces | |

Figure 1:
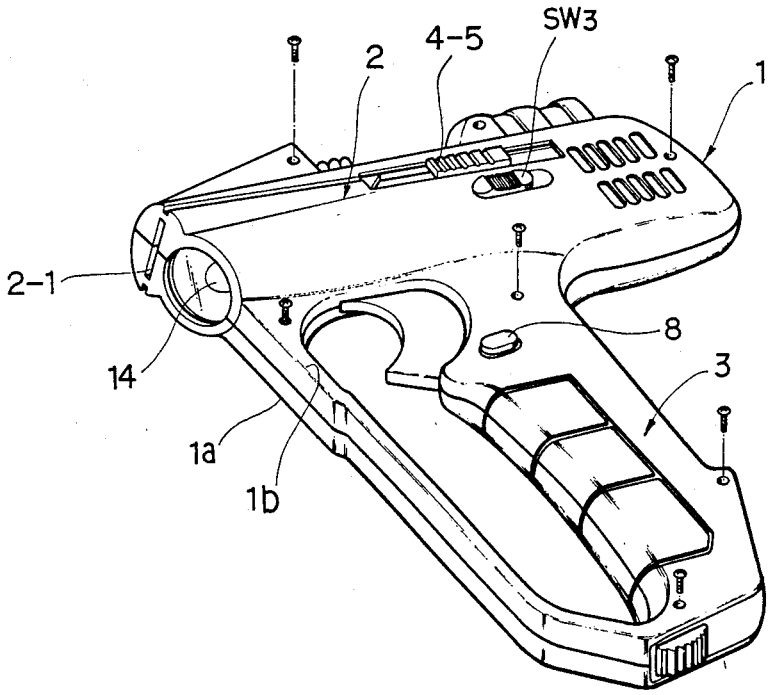
FIG. 1 is a pictorial view of te present invention.
Figure 2A:
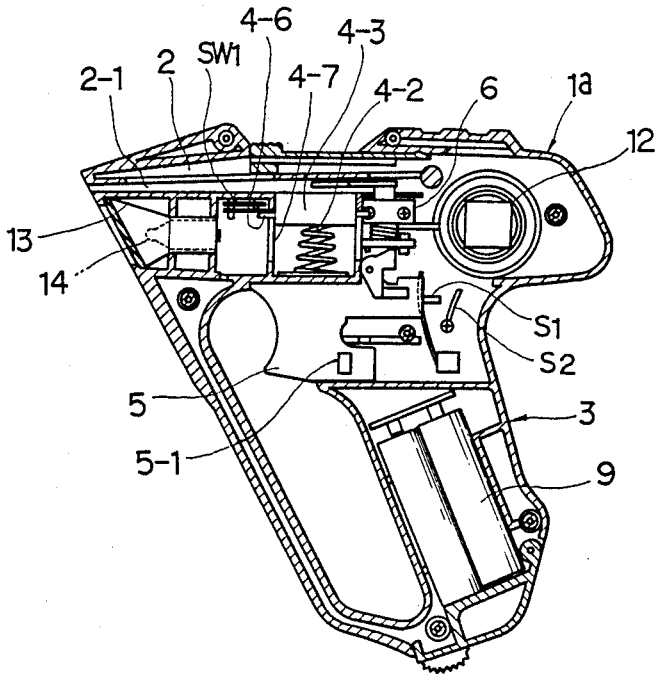
FIG. 2 is a plan view of the inner parts of the present invention shown opened into two separate parts.
Figure 2B:
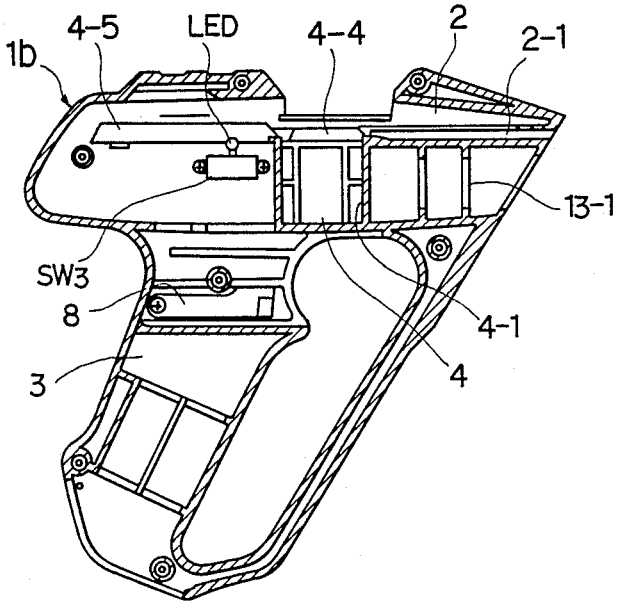

Giving a detailed explanation of the present invention according to the drawings attached hereto, it is as follows:

FIG. 2 shows a view of the present invention with the main body 1 separated into two parts. The separable main body parts 1*a*, 1*b* as shown in FIG. 2 are united to form a revolver-shaped body 1 as shown in FIG. 1.

As illustrated in FIG. 2, the separable main body parts 1*a*, 1*b* comprises a gunbarrel portion 2 and a handle portion 3. In the gunbarrel portion 2 a gunbarrel slot 2-1 separable into two parts is formed and, in the rear thereof, a loading compartment 4-1 separated into two parts which comprises a loading chamber 4 is formed. In the separable loading compartment 4-1 an elastic plate 4-3 with a spring 4-2 attached is installed to push upward those coins which are stacked on it.

In the upper part of loading chamber 4 a coin throwing slot 4-4 is formed and a sliding transparent opening/closing plate 4-5 is installed on it, also serving as a see-through window.

A projection 4-6 is formed on both sides of elastic plate 4-3 and this projection 4-6 is made to move with the elastic plate 4-3 up and down in a groove for ascent and descent within the separable loading compartment 4-1. The projection 4-6 is so formed as to turn on/off the switch SW1 during its motion (see FIG. 6).

Figure 4:
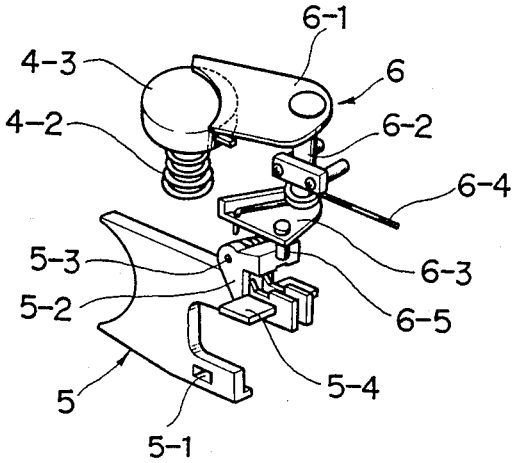
FIG. 4 is a pictorial view of the coin percussion assembly of the present invention.

FIG. 4 is a pictorial view showing the trigger 5and the percussion (coin-striking) assembly 6 of the present invention. The trigger 5 is provided with a safety hole 5-1. It is so installed as to maintain the original (undepressed) state by using a pin 5-3 as its axis and by suspending a spring onto the percussion lever 5-2 in the upper and rear part thereof. The percussion lever 5-2 is made to rotate clockwise by suspending the lower end thereof onto the catching jaw 5-4 formed in the trigger 5.

The percussion assembly 6 has an interlocking plate 6-3 installed coaxially on common axis 6-2 with striking plate 6-1. The striking plate 6-1 is made to return to its original position by installing a spring 6-4 on the axis 6-2 and having a projecting bar 6-5 installed in the interlocking plate 6-3 so as to project downward, so that it may be caught by the rear end of the percussion lever 5-2 of the trigger 5. As to the trigger 5, it is made to return to its original position by installing a flat spring 7 in the rear thereof 5. It is also limited in its backward motion by installing a safety pin 8 in the handle 3 of the separable main body 1 so as to be caught in the safety hole 5-1. When the trigger 5 is pulled into the main body 1, the switch SW2 installed in the rear of the trigger 5 is closed by the trigger's position.

A battery chamber 10 for receiving batteries 9 and a cover 11 are installed within the handles 3. In the rear inner side of separable gunbarrel 2 an alarm 12, a change-over switch SW3 and an LED are installed and connected by wiring as shown in the wiring diagram of FIG. 7. In the lower part of gunbarrel 2-1 an installing groove 13-1 in which a reflecting mirror 13 can be installed is formed. In the groove 13-1 a reflecting mirror 13 and an electric light bulb 14 are installed.

Figure 3:
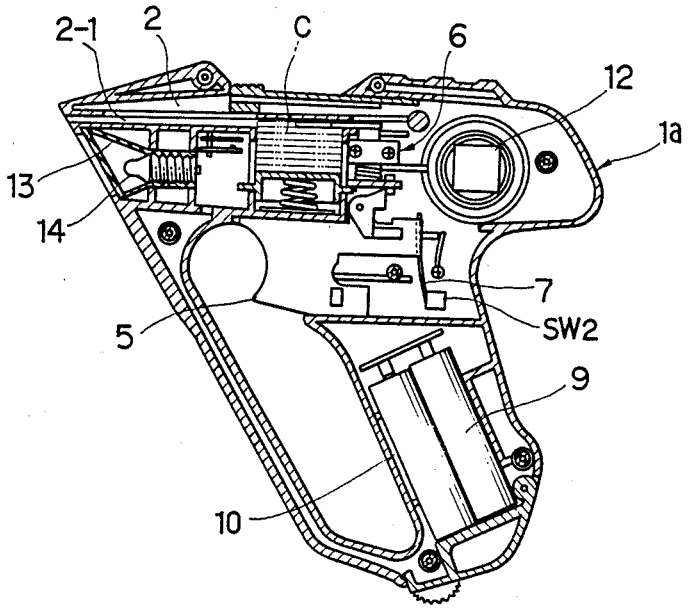
FIG. 3 is a vertical section of the present invention.

Giving an explanation of the working effect of the present invention constituted in such a manner, it is as follows:

To load coins in te present invention, the opening/-closing plate 4-5 must be opened. When coins are put into the coin throwing slot 4-4 one by one, the elastic plate 4-3 installed on the spring 4-2 is pressed down and those coins C put in one by one are stacked thereon as shown by the dotted lines in FIG. 3. Thus, the loading chamber 4 is loaded with coins.

Figure 5A:
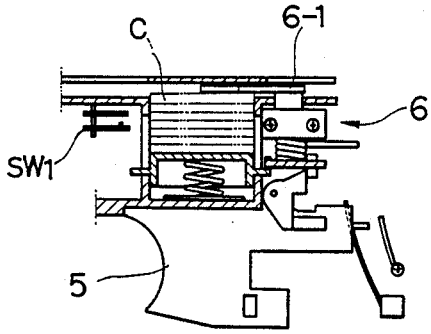
FIG. 5 shows the operation of the present invention.
Figure 5B:
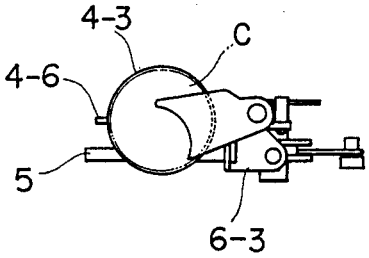
Figure 5C:
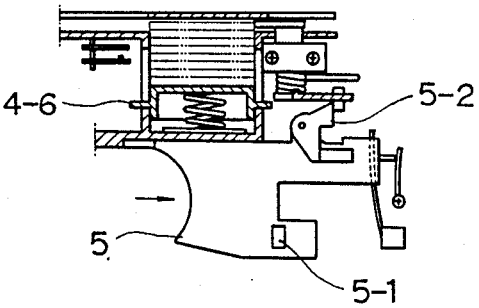

The present invention is used after being loaded with coins. When one intends to throw coins into a coin box by means of the present invention, he must pull the trigger 5 and point the barrel toward the coin box. Giving an explanation of the throwing or coin ejection operation according to FIG. 2, it is as follows:

When the percussion lever 5-2 retreats, it pushes the projecting bar 6-5 of interlocking plate 6-3 backward as shown in FIG. 5(C) from the position as shown in FIG. 5(A). Accordingly, the interlocking plate 6-3 installed with the axis 6-2 as its pivot rotates counterclockwise (as seen from above) and, at the same time, the striking plate 6-1 on the common axis 6-2 also rotates from the state of FIG. 5(B) to the state of FIG. 5(D).

When the striking plate 6-1 moves counterclockwise, the coin C on top of the coin loading chamber 4 located below the striking plate 6-1 comes up to the upper surface of gunbarrel 2-1 by means of the spring 4-2, and the striking plate 6-1 is positioned at the side of the coin C. Thus, the coin C is placed in a position ready to be fired (ejected) through the gunbarrel 2-1.

Figure 5D:
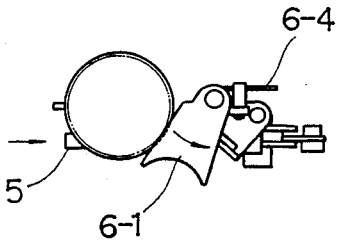
Figure 5E:
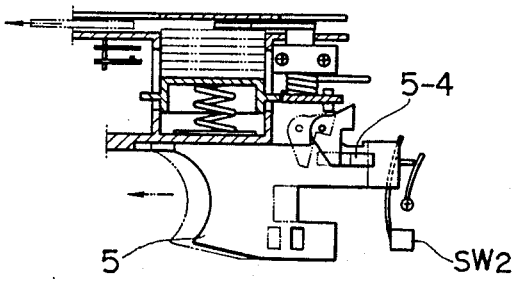
Figure 5F:
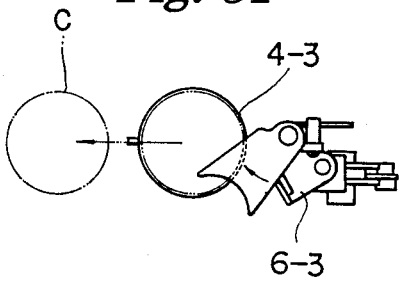

In such a condition, when the trigger 5 moves backward a little more, the percussion lever 5-2 retreating together with hhe trigger 5 separates from the projecting bar 6-5 of interlocking plate 6-3 as shown in FIG. 5(E) and, at the same time, the interlocking plate 6-3 rotates clockwise at a rapid speed by means of the spring 6-4 installed on the axis 6-2 and returns to its original state. At this time, the striking plate 6-1 fixed coaxially with the interlocking plate 6-3 moves, together with the interlocking plate 6-3. So, as shown in FIG. 5(D), the striking plate 6-1 hits the coin C positioned at the side thereof. Thus, the coin C is thrown toward the selected position through the gunbarrel as shown in FIG. 5(F).

As described hereinabove, the present coin throwing gun is able to throw coins to the same distance by means of the spring 6-4 when its trigger 5 is pulled facing the targeted position. For instance, a driver can easily throw a coin into a coin box on a toll road or at a toll tunnel by means of the present invention. Accordingly, the problem of dropping a coin on the ground when thrown by his hand can be solved. Also, because instances where coins are dropped on the ground will be less frequent, the automatic control lifting gate which has already been installed can be utilized effectively. Thus, those coins loaded in the coin loading chamber 4 can be continuously used by being thrown one by one as occasion demands.

Further, in throwing a coin into the coin box, a change-over switch (SW3) can be connected either with the alarm 12 or with the light 14. When the change-over switch SW3 is connected with the alarm 12 and the trigger 5 is pulled, the connecting piece Sl of switch SW2 installed in the rear of trigger 5 comes into contact with a connecting piece S2 and the alarm 12 gives a signal. When the trigger 5 is pulled backward continuously, a coin C is thrown out by the operation of percussion assembly 6, and the fact that the coin C is thrown out is made known to the user by a signal given by the alarm 12. Thus, the device can be effectively used in the daytime. At the same time, the driver can be reassured of operation by such a signal given to him.

Contrary to the above, when the switch SW3 is changed over to select the light 14 and the trigger 5 is pulled backward, the connecting piece Sl of switch SW2 is connected with the connecting piece S2 and the light 14 gets electrical current. Then the percussion assembly 6 operates and a coin C is thrown out in a condition where the light 14 is lit.

As described hereinbefore, coins can be thrown out with the switch SW3 operated to activate the light 14. The invention thus aids a user in correctly throwing coins C into the coin box by reason of the lighted bulb 14.

As just stated, when the trigger 5 is pulled a little to use the lamp 14, the light of lamp 14 can be used in throwing a coin into the coin box. On the other hand, the present invention can be used as a flashlight when the motion of trigger 5 is suspended by pressing the safety pin 8 and fixing the safety hole 5-1 thereon. Thus, the invention may be effectively used to check the vehicle while in operation during the night.

As to the projection 4-6 on the elastic plate 4-3 installed in the coin loading chamber 4, it controls the switch SW1. In a condition where many coins are loaded as shown in FIG. 6(A), the projection 4-6 on the elastic plate 4-3 is separated from the switch SW1 and the switch SW1 is accordingly off. However, when those coins loaded in the coin loading chamber 4 are used up, the switch SW1 is closed by coming into contact with the projection 4-6 on the elastic plate 4-3 and the LED gives a lighted signal. This LED signal shows through the transparent opening/closing plate 4-5 installed on the coin throwing slot 4-4 that the loaded coins are used up. In other words, it can be confirmed from the outside that there is no coin left in the coin loading chamber 4 and, accordingly, that coin must be inserted.

In conclusion, the present invention can be used by a driver to throw coins one by one into a coin box set up on a toll road or at a toll tunnel as occasion calls. During the night in particular, it permits correctly throwing a coin into the coin box by utilizing a light. On the other hand, it can be used as a flashlight. Also, a luminous signal given by its LED signals that coins must be inserted, and an alarm installed therein tells that it has been correctly used.

What is claimed is:

1. A flashlight-coin throwing gun comprising:

a revolver-shaped main body formed by uniting separable main bodies each having a gunbarrel portion and a handle portion;

means within said main body for throwing a coin through said gunbarrel porition;

a coin loading assembly for delivering coins to said means for throwing;

a trigger operably connected to said means for throwing for initiating its operation; and lighting means operably connected to said trigger and to a switch separate from said trigger for selectively projecting a light in the same direction as a coin is thrown upon actuation of said trigger when said switch selects said lighting means;

2. A flashlight-coin throwing gun as recited in claim 1 further comprising light signal means operably connected to said coin loading assembly for signalling that said coin loading assembly needs filling.

3. A flashlight-coin throwing gun as recited in claim 1 in which a gunbarrel slot, a reflecting mirror groove and the walls of a coin loading chamber are formed in the gunbarrel portion of the separable main bodies, a trigger receiving part and a battery chamber are integrated in the handle portion and the revolver-shaped main body 1 is formed by the combination thereof.

4. A flashlight-coin throwing gun as recited in claim 1 wherein the coin loading assembly comprises an elastic plate slidingly mounted for reciprocal movement on a spring in response to coins stacked on the elastic plate.

5. A flashlight-coin throwing gun as recited in claim 4 wherein the coin loading assembly further comprises a projection on the elastic plate, a switch in the gunbarrel portion that is actuated by said projection and a signal light that illuminates upon actuation of the switch in said gunbarrel portion to signal that the coin loading assembly needs to be filled with coins.

6. A flashlight-coin throwing gun as recited in claim 5 further comprising a transparent opening and closing plate in the gunbarrel portion through which the signal light may be observed.

7. A flashlight-coin throwing gun as recited in claim 1 wherein the coin throwing means comprises:

an interlocking plate having a projecting bar and being mounted for rotation on an axis within the main body;

a striking plate for striking coins that is mounted on he same axis for rotation at the same time as the interlocking plate rotates;

elastic means operably connected to said interlocking plate for urging the interlocking plate and the striking plate to rotate to strike a coin; and a percussion lever operably connected to the trigger for transmitting trigger motion to the interlocking plate and causing displacement of the interlocking plate to tension and then release the elastic means.

8. A flashlight-coin throwing gun comprising:

a revolver-shaped main body formed by uniting separable main bodies each having a gunbarrel portion and a handle portion;

means within said main body for throwing a coin through said gunbarrel portion;

a coin loading assembly for deivering coins to said means for throwing;

a trigger operably connected to said means for throwing for initiating its operation;

lighting means operably connected to said trigger for projecting a light in the same direction as a coin is thrown; and electric alarm means operably connected to said means for throwing for signaling the throwing of a coin.

9. A flashlight-coin throwing gun as recited in claim 8 further comprising means for switching the gun between a flashlight mode in which the alarm means is disabled and no coins are thrown and a throwing mode in which either the alarm sounds or the lighting means is illuminated while a coin is being thrown.

10. A flashlight-coin throwing gun as recited in claim 9 wherein the alarm means and the lighting means are selectively controlled in the throwing mode by a change-over switch and each, when selected, is made to turn on and off by a trigger switch operably connected to the trigger.

* * * * *